US008777765B2

(12) United States Patent
Osterman et al.

(10) Patent No.: US 8,777,765 B2
(45) Date of Patent: Jul. 15, 2014

(54) SYSTEM AND METHOD FOR PROVIDING WATER PARK BEACH VISUAL EFFECTS

(75) Inventors: Ross Alan Osterman, Winter Park, FL (US); Justin Michael Schwartz, Orlando, FL (US)

(73) Assignee: Universal City Studios LLC, Universal City, CA (US)

( * ) Notice: Subject to any disclaimer, the term of this patent is extended or adjusted under 35 U.S.C. 154(b) by 372 days.

(21) Appl. No.: 13/083,280

(22) Filed: Apr. 8, 2011

(65) Prior Publication Data

US 2012/0255113 A1 Oct. 11, 2012

(51) Int. Cl.
*A63G 31/00* (2006.01)
*A63H 33/32* (2006.01)

(52) U.S. Cl.
USPC ..... 472/128; 472/61; 446/70

(58) Field of Classification Search
USPC ..... 472/117, 128, 129, 13, 59, 60; 104/69, 104/70; 405/70, 72; 446/70
See application file for complete search history.

(56) References Cited

U.S. PATENT DOCUMENTS 3,192,379 A * 6/1965 De Garmo ..... 362/267
4,300,857 A * 11/1981 Santamaria ..... 405/70
5,219,315 A * 6/1993 Fuller et al. ..... 472/59
6,773,355 B1 * 8/2004 Lekhtman ..... 472/128
6,869,204 B2 * 3/2005 Morgan et al. ..... 362/257
7,371,144 B1 * 5/2008 Begien et al. ..... 446/70

FOREIGN PATENT DOCUMENTS

JP 7223584 8/1995
KR 100978231 8/2010

OTHER PUBLICATIONS

PCT/US2012/031277; Invitation to Pay Additional Fees, mailed Jun. 13, 2012, 8 pages.

* cited by examiner

*Primary Examiner* — Kien Nguyen
(74) *Attorney, Agent, or Firm* — Fletcher Yoder, P.C.

(57) ABSTRACT

Present embodiments are directed to features for maintaining or providing a beach area that is adjacent a water feature and that includes beach surface material disposed in one or more containment structures such that a multi-colored or illuminated beach surface is provided. Present embodiments may include multiple containment structures arrayed in an area adjacent a water feature, wherein each containment structure holds beach surface material of a different color. Further, present embodiments may include creating and/or distributing iridescent and/or phosphorescent beach surface material in one or more containment structures that define the beach area. Additionally, present embodiments may include adjustable or attachable barrier extensions to facilitate maintenance. Further, present embodiments may include transparent or translucent beach surface material disposed in one or more containment structures and a lighting system under the beach surface materials.

18 Claims, 6 Drawing Sheets

SYSTEM AND METHOD FOR PROVIDING WATER PARK BEACH VISUAL EFFECTS

FIELD OF DISCLOSURE

The present disclosure relates generally to the field of amusement parks. More specifically, embodiments of the present disclosure relate to methods and equipment utilized to provide a beach area in a water park, wherein the beach area is visually appealing to park patrons.

BACKGROUND

Water parks have grown in popularity throughout the world in recent years. A water park is a type of amusement park that incorporates water features and rides, such as water slides, spray areas, lazy rivers, swimming pools, wave pools, and other recreational bathing and swimming environments. Water parks may include artificial imitations of nature. For example, many water parks include artificial rivers and rides that simulate river rapids or waterfalls. Water parks also typically include pool areas (e.g., wave pools) that imitate natural bodies of water. Further, water parks may include beach areas that are integral with or surround certain water features. Such beach areas are often positioned around pool areas and other water features to provide a sanitized and controlled version of a natural beach environment. For example, traditional water parks often include beach areas that imitate the natural beaches of ocean, lake, and river shores. Because these beach areas are generally intended to mimic nature, the imitation beach areas often include naturally sand.

DRAWINGS

These and other features, aspects, and advantages of the present invention will become better understood when the following detailed description is read with reference to the accompanying drawings in which like characters represent like parts throughout the drawings, wherein.

Figure 9:
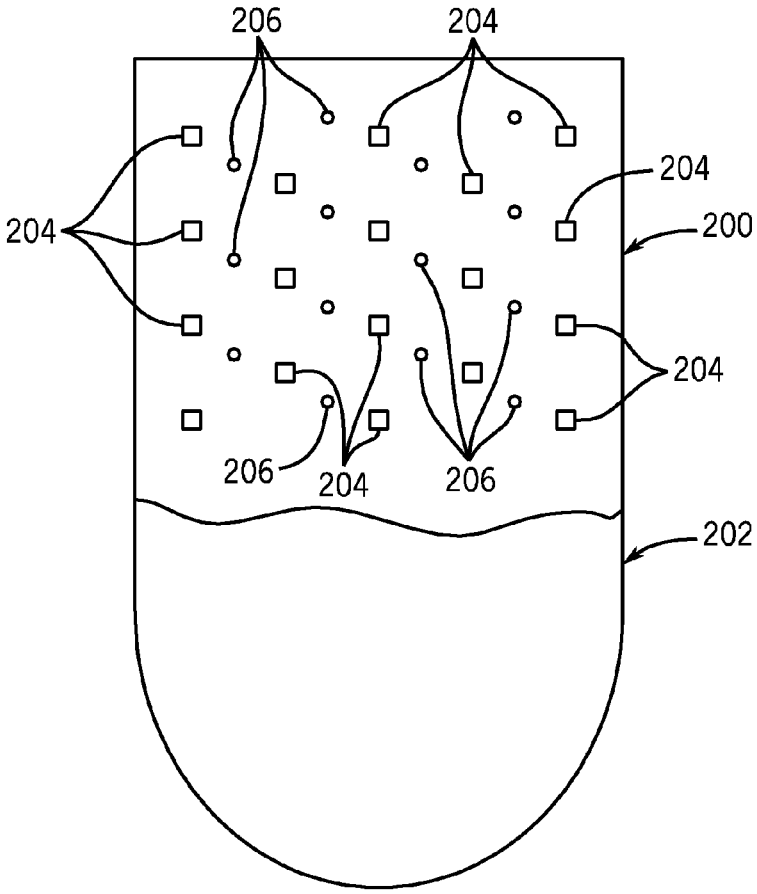
Figure 10:
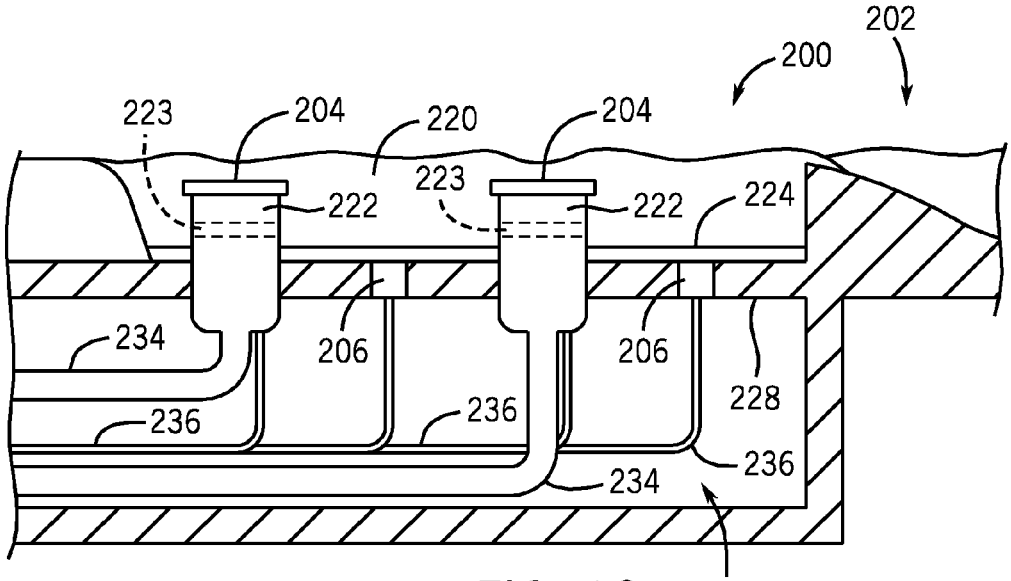

FIG. 9 is a schematic plan view of a water feature adjacent a beach area includes vents positioned beneath beach surface material and configured to release gas or smoke through the beach surface material in accordance with present techniques; and FIG. 10 is a schematic cross-sectional view of the beach area and water feature of FIG. 9, including a maintenance pit positioned beneath the beach area in accordance with present techniques.

DETAILED DESCRIPTION

The present disclosure relates generally to visually interesting beach areas for a water park environment. Beach areas in traditional water parks generally include a beach surface that is positioned such that it is adjacent one or more water features, such as a wave pool, a lazy river, a swimming pool, or a spray area. Such beach areas are traditionally designed to imitate natural environments. Accordingly, these beach areas are typically of a substantially uniform beige or brown color. Indeed, in nature, a beach surface is generally formed from a generally uniformly colored soil that includes sand and/or gravel. Natural sand and gravel are generally defined as granular material composed of finely divided rock and mineral particles. While natural sand typically includes silica (silicon dioxide, or $SiO_2$), which is usually in the form of quartz, the compositions of different types of natural sand and gravel can be highly variable. Indeed, the characteristics of natural sand or gravel in a particular area generally depend on local rock sources and conditions. Natural sand typically includes particles ranging from 0.0625 millimeters to 2 millimeters in diameter, and natural gravel typically includes particles ranging from 2 millimeters to 64 millimeters in diameter.

Present embodiments include beach surface material that is defined as particulate matter or matter composed of distinct particles. This beach surface material may include particle sizes in or near particle size ranges of sand and gravel. Specifically, the beach surface material may include naturally occurring or synthetic particles that are sized within the range of sand and/or gravel. In the present disclosure, beach surface material sized within the range of sand may be referred to as sand-like particles, and beach surface material sized within the range of gravel may be referred to as gravel-like particles. Further, such beach surface material may actually include natural sand or gravel in accordance with present embodiments. Indeed, the beach surface material may include natural materials, modified natural materials, and/or synthetic materials that include certain characteristics (e.g., coloring, translucence, iridescence, phosphorescence) that cooperate with other aspects of present techniques to provide interesting visual effects for a beach area.

Specifically, present embodiments may include features for maintaining or providing a beach area that is adjacent a water feature (e.g., a wave pool, a lazy river, a swimming pool, a spray area) and that includes beach surface material (e.g., sand-like and/or gravel-like particles) disposed in one or more containment structures such that a multi-colored (e.g., rainbow) or illuminated (e.g., back-lit) beach surface is provided. Specifically, for example, present embodiments may include multiple containment structures that are arrayed in an area adjacent a water feature and that each hold a beach surface material of a different color. Thus, present embodiments may include a multi-colored beach area, such as a rainbow beach, formed by various sections including the different colors of beach surface material. Further, present embodiments may include adjustable or attachable barrier extensions to facilitate maintenance. In another embodiment, a visually interesting beach area may be provided by creating and/or distributing iridescent and/or phosphorescent beach surface material in one or more containment structures that define the beach area. In yet another embodiment, transparent or translucent beach surface material may be disposed in the one or more containment structures. Further, light sources may be positioned under the beach surface materials such that light can be emitted from behind the beach surface material to provide an illuminated and/or multi-colored beach surface. Further, the containment structures may include or be positioned over a transparent or translucent base (e.g., a clear shell or membrane) or shelf such that the sand-like and/or gravel-like particles do not directly contact the light sources.

Figure 1:
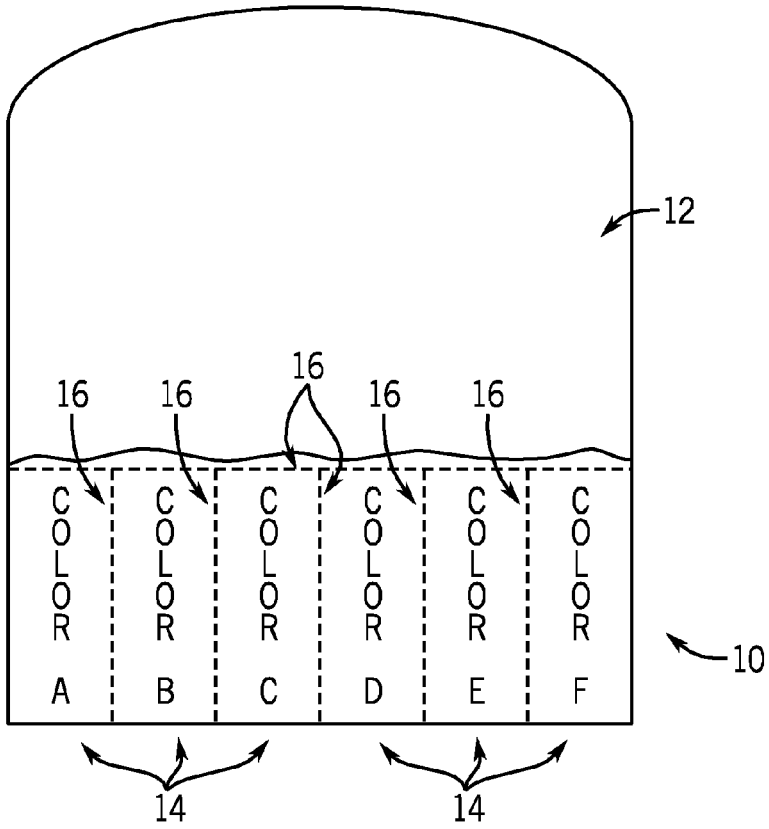
FIG. 1 is a schematic plan view of a water feature adjacent a segmented beach with generally rectangular containment structures in accordance with present techniques.

Turning to the figures, FIG. 1 is a schematic plan view of a multi-colored beach 10 adjacent a swimming pool 12 in accordance with present embodiments. In other embodiments, the multi-colored beach 10 may be positioned adjacent one or more different types of water features. The beach 10 is composed of multiple sections 14 of colored beach surface material, which may overlap with and mix with the pool. In accordance with present embodiments, the sections 14 may be parallel, perpendicular, or otherwise arranged with respect to the swimming pool 12 or another water feature. The colored beach surface material may include Sandtastik® Colored Sand available from Sandtastik Products Inc., which has an office at 1711 Cudaback Ave, Suite 253, Niagara Falls, N.Y. 14303, or Crayola® Play Sand available from Crayola LLC, which is headquartered at 1100 Church Lane, Easton, Pa. 18044-0431. Specifically, in the illustrated embodiment, the beach includes six different sections 14, wherein each of the sections 14 includes a different color of beach surface material (as indicate by the text indicating Colors A-F). In some embodiments, a different number of sections and colors of beach surface material may be employed.

The sections 14 are generally defined by containment structures 16 that are at least partially covered by the beach surface material (e.g., sand) and function to prevent excessive mixing of the different colors of beach surface material at locations on the beach 10 where different colors of the beach surface material are adjacent one another. The containment structures 16 also prevent excessive amounts of beach surface material from entering the pool 12. While some mixing of the different colors of beach surface material may occur around the beach surface and some amount of beach surface material may enter the pool 12, the containment structures 16 generally function to resist excessive mixing and may also facilitate maintenance of the beach 10 in accordance with present embodiments.

Figure 2:
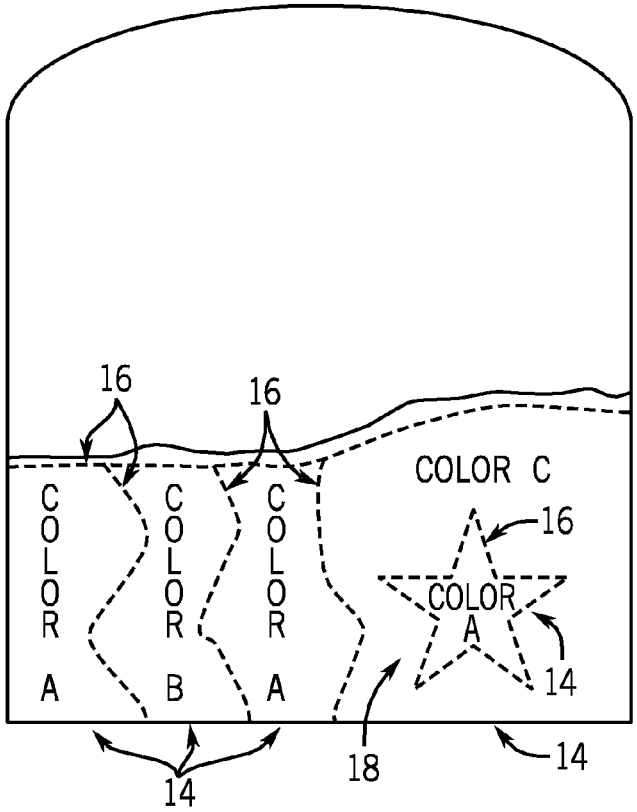
FIG. 2 is a schematic plan view of a water feature adjacent a segmented beach with containment structures with assorted shapes in accordance with present techniques.

In the illustrated embodiment, the various sections 14 are filled with different colors of beach surface material to provide a unique overall pattern or visual effect. Indeed, the different colors of beach surface material in the various sections 14 may combine to form a rainbow. In other embodiments, different arrangements and colors may be utilized, as illustrated by the embodiment represented in FIG. 2. While the embodiment illustrated in FIG. 1 includes generally rectangular containment structures 16, the containment structures 16 illustrated in FIG. 2 result in different shapes on the beach surface. Indeed, FIG. 2 illustrates that certain of containment structures 16 may surround others to define shapes. Further, fewer colors of beach surface material are employed in FIG. 2 relative to FIG. 1 such that a different visual effect is achieved. Specifically, the containment structures 16 illustrated in FIG. 2 are arranged to define curving boundaries and a star shape 18, which is formed from one of the containment structures 16 that is surrounded by another of the containment structures 16. The colors of beach surface material disposed in the containment structures of FIG. 2 may correspond to red, white, and blue to provide an American patriotic theme in accordance with present embodiments.

Figure 3:
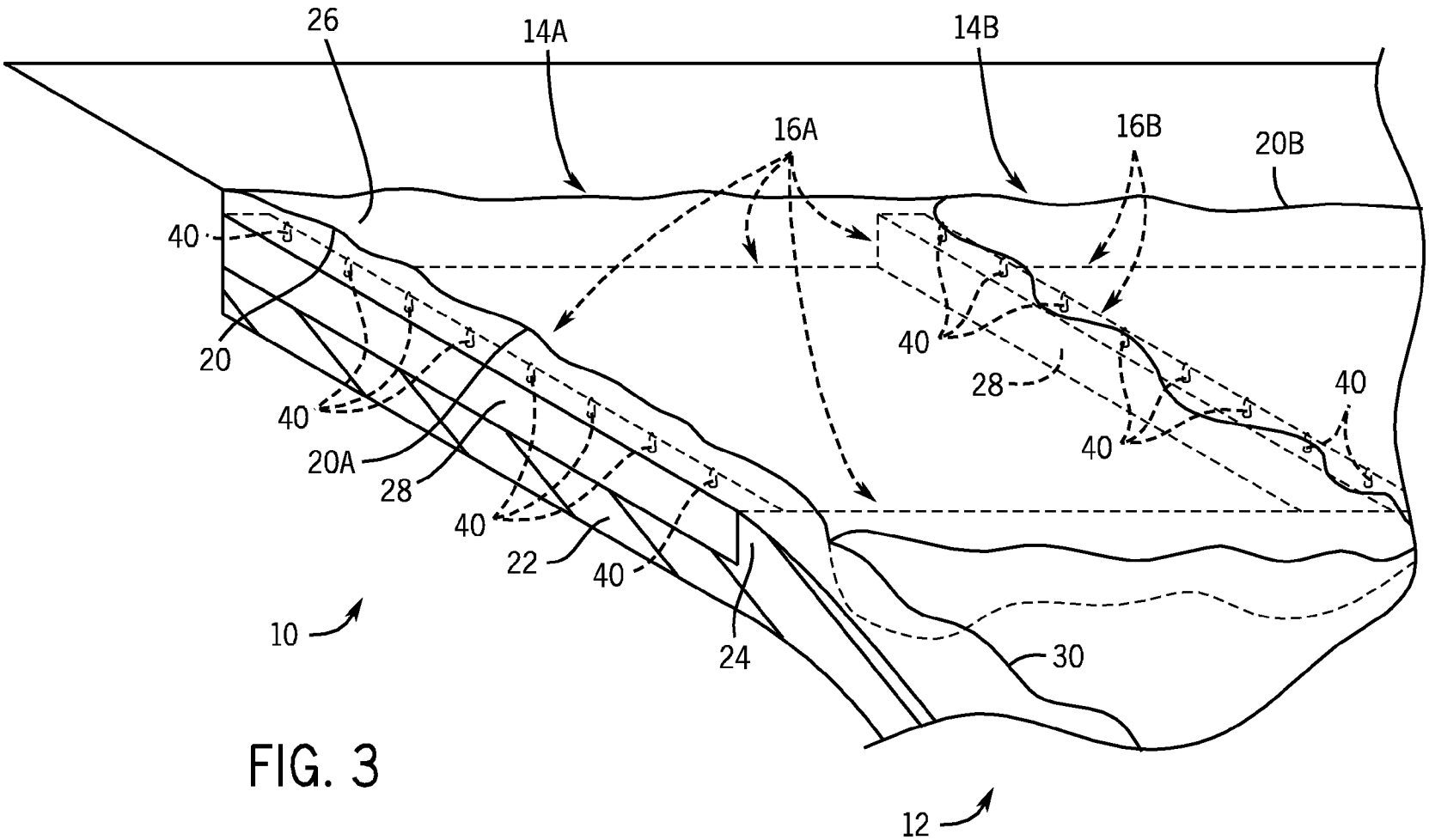
FIG. 3 is a schematic cross-sectional view of the water feature and adjacent beach of FIG. 1 in accordance with present techniques.

FIG. 3 is a cross-sectional perspective view of the beach 10 adjacent the pool 12 in accordance with present embodiments. The beach 10 includes beach surface material 20 disposed within and over the containment structures 16 that define the sections 14. In some embodiments, the beach surface material 20 includes regular sand or gravel at the base and visually appealing beach surface material at the top. The beach surface material 20 or the visually appealing component of the beach surface material 20 is of a sufficient depth to maintain color and an appropriate feel throughout daily operations and use. Specifically, in the illustrated embodiment, the beach surface material 20 includes different colors of sand disposed substantially in different sections 14. A first colored sand 20A is disposed within and/or above a first containment structure 16A to form a first section 14A, and a second colored sand 20B is disposed within and above a second containment structure 16B to form a second section 14B. The sands 20A and 20B in sections 14A and 14B, respectively, may mix near the surface but are separated beneath the surface by components of the containment structures 16. Further, the sand 20 is generally blocked from flowing into the pool 12 by the containment structures 16. However, there is some overlap between the beach 10 and the pool 12.

The containment structures 16 are formed from a foundation 22, a lip 24, a rear wall 26, and partitions 28. In the illustrated embodiment, there is no upper boundary on the containment structures 16, which allows the sand 20 to fill and overflow the containment structures 16 such that there is a sufficient layer between patrons on the beach surface and components of the containment structures 16. Indeed, the sand 20 may extend a sufficient distance between an uppermost portion of the containment structures 16 to avoid contact between the containment structures 16 and patrons participating in activities (e.g., walking or lounging) on the beach surface. In some embodiments, a screen may be employed as an upper boundary of one or more of the containment structures 16 to facilitate maintenance of the beach surface materials 20 or further resist mixing between different beach surface material colors, while providing the general tactile feel of a natural beach. Further, the components of each of the containment structures 16 may be colored to correspond with a color of the sand 20 disposed in the corresponding containment structure such that any exposed portion of the containment structures 16 will visually blend with the sand 20 disposed therein.

Specifically, in the illustrated embodiment, the foundation 22 (e.g., a concrete layer) functions as a base of the containment structures 16. The foundation 22 may also form a base or container for the pool 12. In other embodiments, a single foundation 22 may not be shared between multiple containment structures 16 and/or the water feature (e.g., the pool 12). Further, the lip 24, which is a portion of the foundation 22 in the illustrated embodiment, extends upward along a boundary between the beach 10 and the pool 12. The lip 24 functions to resist excessive intermingling of the sand 20 with water 30 in the pool 12. A certain amount of sand 20 in the pool 12 may be acceptable. Indeed, in the illustrated embodiment, there is an overlap 32 between the sand 20 and the water 30. However, it may be desirable to include the lip 24 to block substantial flow of the sand 20 into the water 30. This may be particularly applicable in embodiments wherein the pool 12 is a wave pool, which may operate to draw the sand 20 into the pool 12 due to wave action on the beach 10. In the illustrated embodiment, the lip 24 is angled abruptly upward on the side facing the sand 20 and angles downward into the pool 12 to provide a sloping shore. However, in other embodiments, the lip 24 may include different geometric features. Further, in some embodiments, the lip is a separate feature from the foundation 22. Indeed, the lip 24 may include features similar or identical to the illustrated partitions 28.

In the illustrated embodiment, the partitions 28 extend between the rear wall 26 and the lip 24 to separate and define the sections 14. The rear wall 26 may be an edge of soil, concrete, or the like. Further, in some embodiments, features similar or identical to the illustrated partitions 28 may be utilized as the rear wall 26. While the embodiment illustrated in FIG. 3 shows the partitions 28 being arranged in a substantially parallel fashion, in other embodiments, the partitions 28 may be arranged to define various different shapes or contours for the defined sections 14. For example, the partitions 28 may be arranged to provide the sections 14 depicted in FIG. 2.

Figure 4:
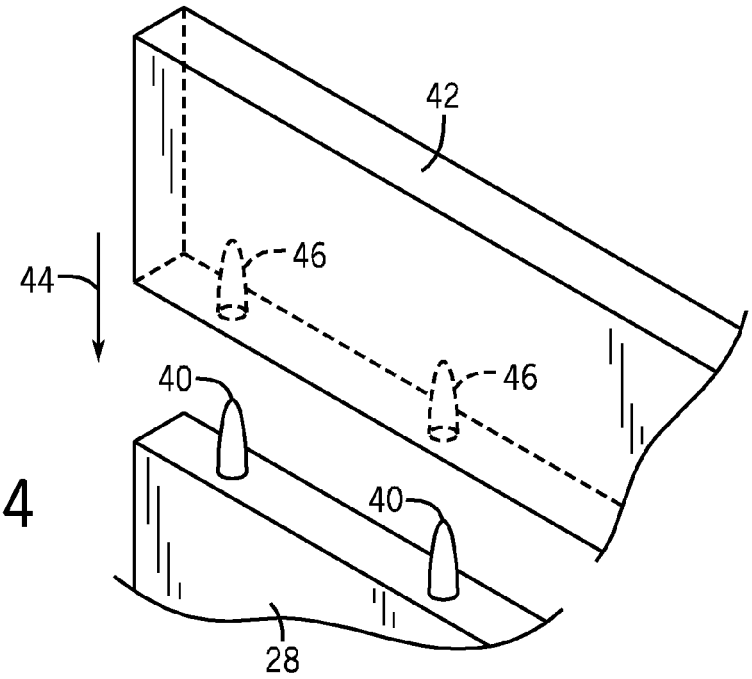
FIG. 4 is a perspective view of a separator coupling with a portion of a containment structure in accordance with present techniques.
Figure 5:
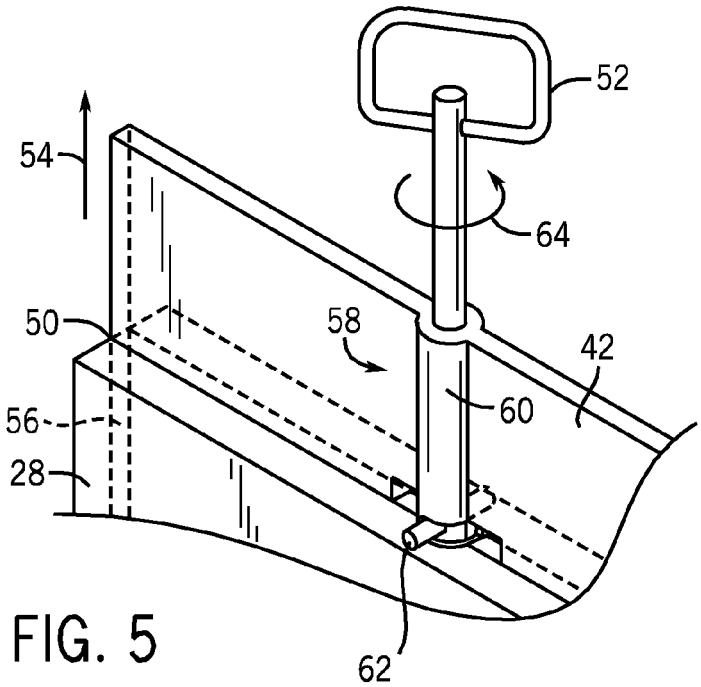
FIG. 5 is a perspective view of a separator extending from a portion of a containment structure in accordance with present techniques.

Aspects of the containment structures 16 may facilitate coupling or engagement with boundary extensions or separators that facilitate beach maintenance. Specifically, for example, the partitions 28 illustrated in FIG. 3 include prongs 40 that are configured to couple with separators that are sized to extend above the beach surface when installed. FIG. 4 provides a perspective view of a separator 42 being coupled with a portion of one of the partitions 28. Specifically, the separator 42 is being lowered (as illustrated by arrow 44) with respect to the partition 28 in FIG. 4 to facilitate coupling between the prongs 40 and receptacles 46 in the separator 42. By arranging the separator 42 in this fashion, the beach 10 may be more readily maintained. For example, the beach surface material 20 may be raked or additional beach surface material 20 may be added without causing a substantial amount of mixing between the sections 14. Indeed, for example, the separator 42 may serve to block the first colored sand 20A from being mixed with the second colored sand 20B while providing additional amounts of the first colored sand 20A to the first section 14A. In other embodiments, the separator 42 may not be coupled with the containment structure 16 and may simply be wedged into the layer of the beach surface material 20. In yet another embodiment, as illustrated in FIG. 5, the separator 42 may slide up from within the containment structure 16 through a separator guide 50. Indeed, the separator 42 may include a handle 52 that a maintenance worker can access and pull up, as illustrated by arrow 54, to extend the separator 42 out of a pocket 56 within the containment structure 16. Further, the separator 42 may include a latching feature 58 with a rod 60 and a catch 62. The rod 60 may be rotated, as represented by arrow 64, by turning the handle 52 such that the catch 62 extends over the containment structure 16, as illustrated in FIG. 5. Thus, when activated, the catch 62 is configured to abut an edge of the containment structure 16 to prevent the separator 42 from sliding back into the pocket 56. The use of separators 42 such as these may facilitate maintenance.

Figure 6:
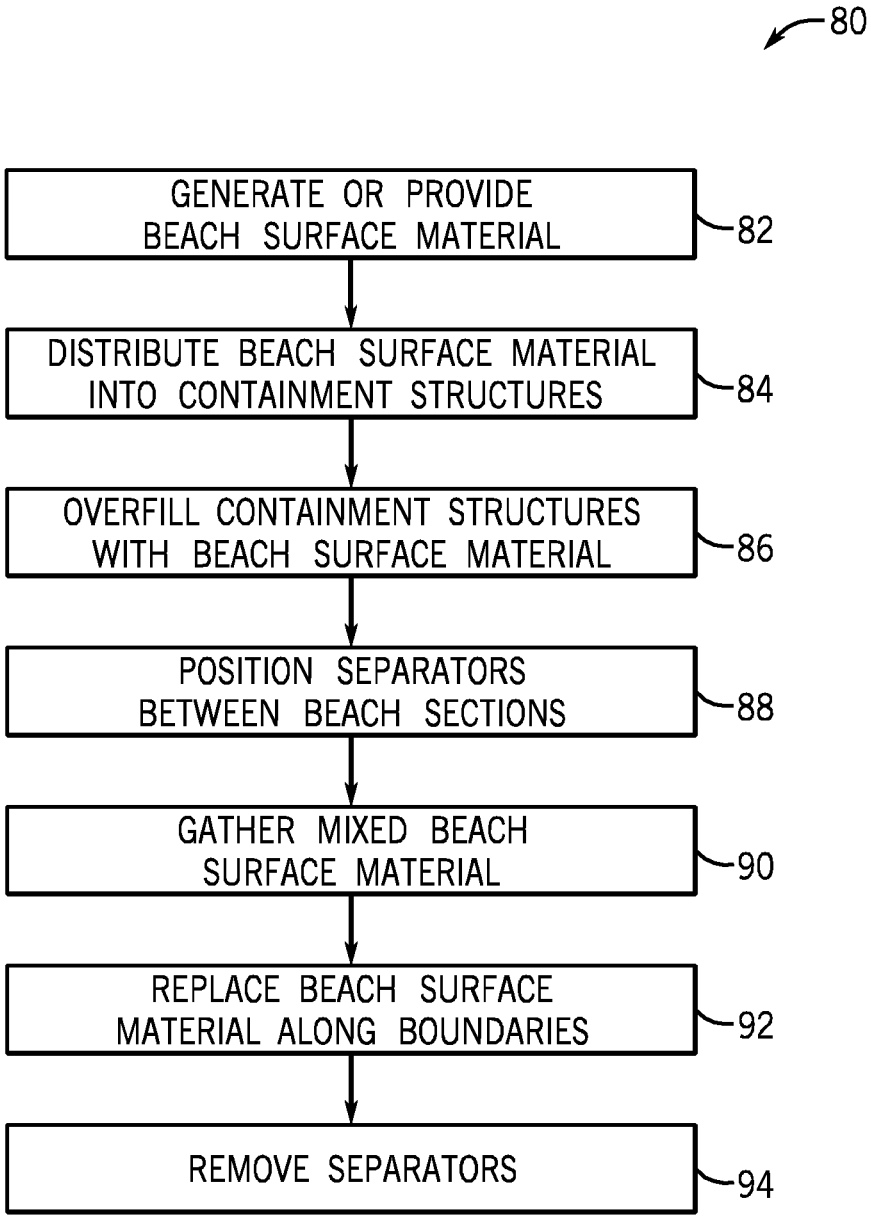
FIG. 6 is a process flow diagram of method of providing an maintaining a beach area in accordance with present techniques.

FIG. 6 is a process flow diagram illustrating a method 80 of providing and maintaining a beach area in accordance with present embodiments. The method 80 begins with generating or providing various types (e.g., different colors) of beach surface material, as represented by block 82. In one embodiment, this includes grinding or crushing a particular type of material (e.g., iridescent or translucent material) into particles (e.g., sand-like or gravel-like particles) appropriate for the beach surface material. This may include mixing with natural sand or gravel. In one embodiment, this includes dying particulate matter (e.g., natural sand or gravel). Once the beach surface material is acquired or provided, it is distributed into containment structures that define sections of the beach area, as represented by block 84. This may include filling adjacent structures with different types of beach material to provide an overall pattern for the beach area. Once the sections are filled, they may be slightly overfilled such that the beach surface material extends over the containment structures in areas where patrons participate in activities on the beach area, as represented by block 86. This generally results in mixing of different types of beach surface material at adjoining sections of the beach area. Further, as patrons move along the beach area, these areas will become further mixed. Accordingly, the beach area may require maintenance to continue to provide the desired appearance. Such maintenance may include positioning separators between adjacent sections of the beach that have different types of beach surface material such that the separators extend through the beach surface material an upward, as represented by block 88. This may include wedging separators into the beach surface material along boundaries (e.g., up to 1 inch below the surface), coupling separators with features of the containment features, or extending separators from the containment features. The mixed beach surface material may be gathered (e.g., with shovels) and removed from the beach area, as represented by block 90, while the separators are in place or before positioning the separators. While the separators are in place, replacement beach surface material may be provided along the barriers by pouring or dumping it along the appropriate side of the separators, as represented by block 92. The separators prevent excessive mixing of the beach surface material along boundaries while additional beach surface material is added. After the desired amount of beach surface material has been added on one or both sides of the separators, the separators may be removed, as represented by block 94.

Figure 7:
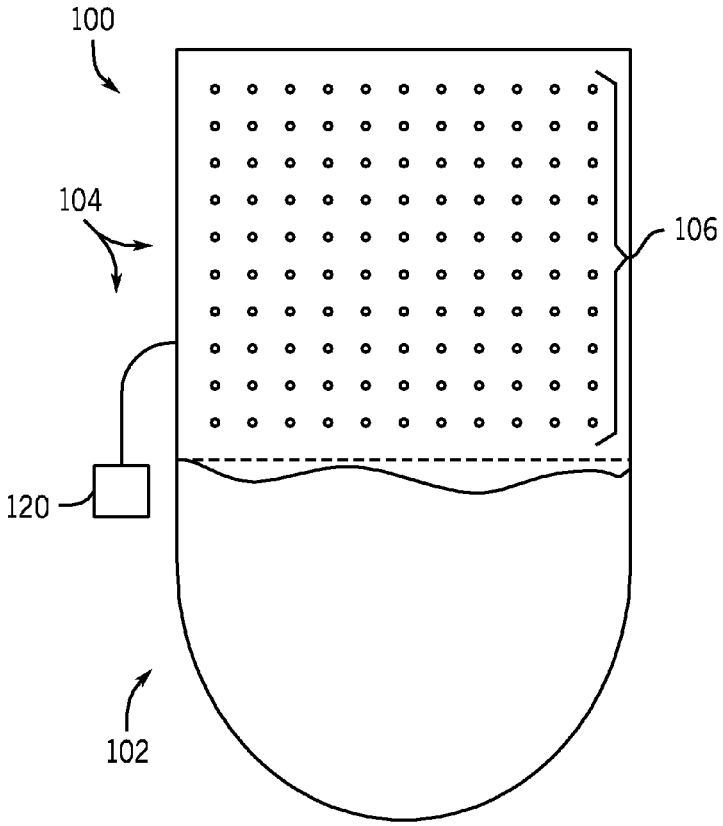
FIG. 7 is a schematic plan view of a water feature adjacent a beach area capable of illumination from a lighting system positioned beneath transparent or translucent beach surface material in accordance with present techniques.
Figure 8:
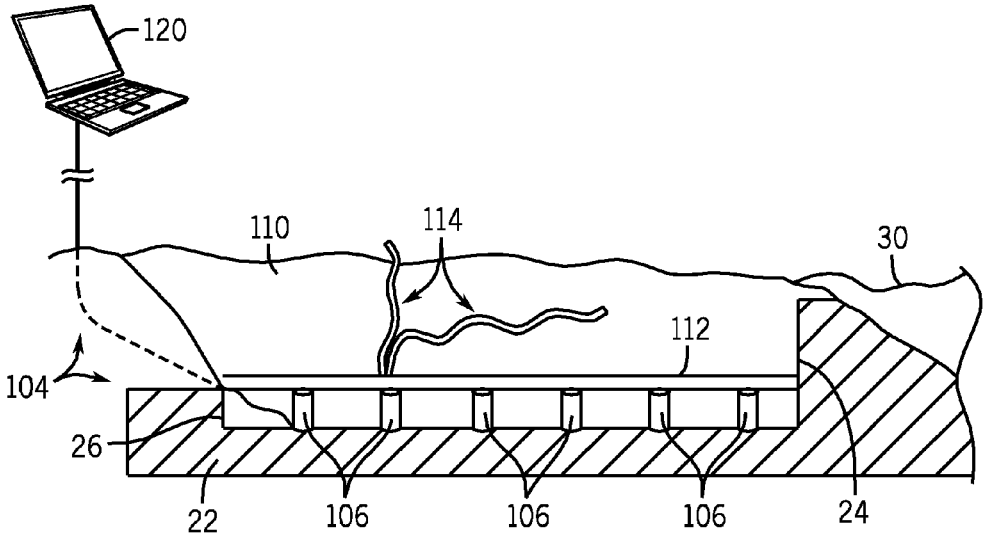
FIG. 8 is a schematic cross-sectional view of the beach area of FIG. 7 in accordance with present techniques.

FIG. 7 illustrates a schematic plan view of a rear-illuminated or projected beach 100 adjacent a water feature 102 in accordance with present embodiments. As illustrated in FIG. 7, the beach 100 may include a lighting system 104 including an array of light emitters 106 (e.g., light emitting diodes, halogen lamps, light sources coupled with fiber optic cable or strands) positioned in a grid pattern along the beach area. The light emitters 106 may be positioned in different arrangements (e.g., different distances apart and in different shape configurations) with respect to one another in different embodiments. As illustrated in FIG. 8, which is a schematic cross-sectional view of the beach 100, the light emitters 106 are positioned beneath translucent beach surface material 110 such that, when activated, the light emitters 106 project light into the beach surface material 110. Depending on the depth of the beach surface material 110, the nature of the beach surface material 110, desired effects, and so forth, varying brightness levels for the light emitters 104 may be desired and utilized.

Further, depending on the type of light emitters 106, it may be desirable to prevent direct contact between the light emitters 106 and the beach surface material 110. For example, this may be done to prevent melting of the beach surface material 110. In the illustrated embodiment, the beach surface material 110 (e.g., phosphorescent particles) is disposed over a partition 112 (e.g., a shell or film) made of clear or translucent material. This partition 112 serves to substantially separate the beach surface material 110 from components of the lighting system 104 (e.g., the light emitters 106), which may protect the lighting system 104 while allowing light to pass from the lighting system 104 to the beach surface material 110. However, in other embodiments, the lighting system 104 may be in direct contact with the beach surface material 110. Further, in the illustrated embodiment, fiber optic cable 114 extends into the beach surface material 110 from the lighting system 104 to provide interesting visual effects. Indeed, the fiber optic cable 114 may extend to the surface to provide imitation grass that is illuminated.

The lighting system 104 may include a controller 120 that is configured to activate the light emitters 106. The controller 120 may be local and/or remote with respect to the beach 100. The controller 120 may include a computer or a programmable logic controller that is configured to control input/output components and other control system features to manage the lighting system 104. In some embodiments, the controller 120 includes a processor and a non-transitory computer-readable medium storing code configured to activate switching and the like for the lighting system 104. In operation, the controller 120 may simply turn the light emitters 106 on and off, or the controller 120 may be configured to coordinate colors, brightness, activation, and so forth. Indeed, in some embodiments, the controller 120 and the light emitters 106 may coordinate to provide animations. In fact, the light emitters 106 may be densely arranged to provide adequate resolution for displaying full motion video (e.g., movies). In some embodiments, coloring may be provided by the lighting system 104, by colored lenses on the light emitters 106, by tinting of the translucent beach surface material 110, or a combination thereof.

FIG. 9 illustrates a schematic plan view of a beach 200 adjacent a water feature 202, wherein the beach includes smoke or gas vents 204 in accordance with present embodiments. Specifically, the beach 200 in the illustrated embodiment includes light emitters 206 and the vents 204 arranged in a pattern throughout the beach 200. In other embodiments, different patterns may be used. Beach surface material covering the beach 200 may be translucent or include translucent areas such that light from the light emitters 206 can pass through to provide an interesting visual effect, as discussed above. This effect may be enhanced with smoke or gas (e.g., fog from dry ice) emanating from the vents 204. Indeed, smoke or gas that is lighter than air may be released from the vents 204 such that it passes up to the surface through the beach surface material. In some embodiments, pressure may be utilized to push gas or smoke through the vents 204. While the illustrated embodiment includes both the light emitters 206 and the vents 204, in other embodiments only the light emitters 206 or the vents 204 may be included. Further, in other embodiments, non-translucent beach surface material may be employed. For example, colored and/or natural beach surface material may be used.

FIG. 10 is a schematic cross-sectional view of the beach 200 and a portion of the water feature 202 in accordance with present techniques. As illustrated in FIG. 10, beach surface material 220 may be positioned over the vents 204 and light emitters 206. The vents 204 may include filters 222 (e.g., a gas-permeable foam or sponge-like element) to block sand from entering the vents 204, which might result in clogging. The vents 204 may include features 223 (e.g., louvers) capable of being opened and closed remotely to control release of smoke or gas. The vents 204 may extend through a transparent or translucent layer 224 (e.g., a film or shell) that protects or blocks the light emitters 206 from direct contact with the beach surface material 220. Both the vents 204 and the light emitters 206 may include components that extend beneath a foundation 228 (e.g., a concrete layer) for the beach 200 into a maintenance cavity or pit 230 positioned beneath the beach 200 to provide access to the vents 204 and/or the light emitters 206 for maintenance purposes. Indeed, the maintenance pit 230 may allow workers to replace light emitters 206, clean vents 204, and the like without requiring removal of the beach surface material 220 to access these features. Also, as illustrated in FIG. 10, tubing 234 and wiring 236 for the vents 204 and light emitters 206 may be disposed within the maintenance pit 230. Such tubing 234 and wiring 236 may provide power, gas, smoke, and so forth to the vents 204 and light emitters 206 from a remote location (e.g., a surface location). For example, a control system may control the supply of gas and electricity to the vents 204 and the light emitters 206 via the tubing 234 and wiring 236. Thus, the control system can cause certain areas of the beach to release smoke or gas (e.g., different colors of smoke or gas) from the vents 204 in conjunction with providing lighting effects (e.g., different colors, patterns, and/or intensities of light) from the light emitters 206 and so forth.

While only certain features of the invention have been illustrated and described herein, many modifications and changes will occur to those skilled in the art. It is, therefore, to be understood that the appended claims are intended to cover all such modifications and changes as fall within the true spirit of the invention.

The invention claimed is:

1. A beach area, comprising:

a water feature;

a plurality of containment structures disposed adjacent the water feature and over an area sufficiently sized to facilitate recreational activities for patrons thereon; and one or more beach surface materials disposed within and extending above each of the plurality of containment structures, wherein each containment structure is predominantly filled by a different color of the one or more beach surface materials such that the one or more beach surface materials and the containment structures combine to provide a multi-colored beach surface for the beach area, wherein at least one of the plurality of containment structures comprises receptacles configured to receive a separator that is configured to extend above the beach surface materials when coupled to the receptacles.

2. The beach area of claim 1, wherein the water feature comprises a water containment feature.

3. The beach area of claim 1, wherein the plurality of containment structures are positioned within and/or form a recess between a lip of the water feature and a wall along an outer perimeter of the beach area.

4. The beach area of claim 1, wherein the beach surface materials comprise one or more of translucent, dyed, iridescent, or phosphorescent beach surface materials.

5. A beach area, comprising:

a water feature;

a plurality of containment structures disposed adjacent the water feature and over an area sufficiently sized to facilitate recreational activities for patrons thereon; and one or more beach surface materials disposed within and extending above each of the plurality of containment structures, wherein each containment structure is predominantly filled by a different color of the one or more beach surface materials such that the one or more beach surface materials and the containment structures combine to provide a multi-colored beach surface for the beach area, wherein at least one of the plurality of containment structures comprises a guide and a separator, wherein the separator is configured to slide out of the guide such that the separator extends above the beach surface materials.

6. A beach area, comprising:

a water feature;

a plurality of containment structures disposed adjacent the water feature and over an area sufficiently sized to facilitate recreational activities for patrons thereon;

one or more beach surface materials disposed within and extending above each of the plurality of containment structures, wherein each containment structure is predominantly filled by a different color of the one or more beach surface materials such that the one or more beach surface materials and the containment structures combine to provide a multi-colored beach surface for the beach area; and at least one vent positioned beneath the one or more beach surface materials, wherein the vent is configured to release gas or smoke through the one or more beach surface materials.

7. A beach area, comprising:

a water feature;

a layer of translucent beach surface material disposed over an area sufficiently sized to facilitate recreational activities for patrons thereon, wherein the area is adjacent the water feature;

a lighting system disposed vertically beneath the layer and configured to emit light through the layer; and at least one vent positioned beneath the translucent beach surface materials, wherein the vent is configured to release gas or smoke through the translucent beach surface materials.

8. The beach area of claim 7, comprising a translucent or transparent partition disposed between the lighting system and the layer, wherein the partition is configured to substantially block the translucent beach surface material from contact with the lighting system.

9. The beach area of claim 7, wherein the translucent beach surface material includes sections of opaque material.

10. The beach area of claim 7, wherein the lighting system comprises a plurality of light sources arranged in a grid pattern.

11. The beach area of claim 7, wherein the layer of translucent beach surface material fills and extends over a containment structure.

12. The beach area of claim 7, wherein the lighting system comprises a plurality of light emitters disposed within a containment structure with a transparent membrane or shell disposed over the light emitters and separating the light emitters from the translucent beach surface materials.

13. The beach area of claim 7, wherein the lighting system is coupled with fiber optic cabling that extends into the layer.

14. The beach area of claim 7, wherein the light system comprises an array of light emitters and is configured to present full motion video via illumination of the layer with the array of light emitters.

15. The beach area of claim 7, comprising a plurality of containment structures positioned over the area, wherein the layer of translucent beach surface material fills and extends over a one of the plurality of containment structures.

16. The beach area of claim 15, comprising different colors or types of beach surface material disposed in each of the plurality of containment structures.

17. The beach area of claim 7, wherein the light system is configured to project patterns via illumination of the layer.

18. A beach area, comprising:

a water feature;

a layer of translucent beach surface material disposed over an area sufficiently sized to facilitate recreational activities for patrons thereon, wherein the area is adjacent the water feature;

a lighting system disposed vertically beneath the layer and configured to emit light through the layer;

a plurality of containment structures positioned over the area, wherein the layer of translucent beach surface material fills and extends over a one of the plurality of containment structures; and a maintenance pit positioned under at least a portion of the lighting system to provide access to the lighting system.

* * * * *